US008876741B2

(12) United States Patent
Matsuoka

(10) Patent No.: US 8,876,741 B2
(45) **Date of Patent: *Nov. 4, 2014**

(54) BODY WEIGHT SUPPORT DEVICE

(75) Inventor: Yoshihisa Matsuoka, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 746 days.

This patent is subject to a terminal disclaimer.

(21) Appl. No.: 13/139,836

(22) PCT Filed: Nov. 6, 2009

(86) PCT No.: PCT/JP2009/005908

§ 371 (c)(1),
(2), (4) Date: Jun. 15, 2011

(87) PCT Pub. No.: WO2010/070807

PCT Pub. Date: Jun. 24, 2010

(65) Prior Publication Data

US 2011/0251534 A1 Oct. 13, 2011

(30) Foreign Application Priority Data

Dec. 17, 2008 (JP) ..... 2008-321025

(51) Int. Cl.

| | |
|---|---|
| ***A61H 1/00*** | (2006.01) |
| ***A61H 1/02*** | (2006.01) |
| ***A61H 5/00*** | (2006.01) |
| ***A61H 3/00*** | (2006.01) |

(52) U.S. Cl.

CPC ..... *A61H 3/008* (2013.01); *A61H 2201/1676* (2013.01); *A61H 2201/12* (2013.01); *A61H 3/00* (2013.01); *A61H 2201/1633* (2013.01); *A61H 2201/165* (2013.01); *A61H 2201/1623* (2013.01); *A61H 1/024* (2013.01); *A61H 2201/1642* (2013.01)

USPC ..... 601/5; 601/33; 601/34; 601/35

(58) Field of Classification Search

USPC ..... 601/33, 34, 35; 602/16

See application file for complete search history.

(56) References Cited

U.S. PATENT DOCUMENTS

| | | | | |
|---|---|---|---|---|
| 4,872,665 | A | 10/1989 | Chareire | |
| 4,967,734 | A * | 11/1990 | Rennex | 602/23 |
| 7,544,155 | B2 * | 6/2009 | Agrawal et al. | 482/69 |
| 7,578,799 | B2 * | 8/2009 | Thorsteinsson et al. | 602/5 |

(Continued)

FOREIGN PATENT DOCUMENTS

| | | |
|---|---|---|
| JP | 49-124459 | 11/1974 |
| JP | 4-107193 | 9/1992 |

(Continued)

*Primary Examiner* — Justine Yu
*Assistant Examiner* — Kathrynn Reilly
(74) *Attorney, Agent, or Firm* — Rankin, Hill & Clark LLP

(57) ABSTRACT

A coil spring 14 is provided in a leg link 3. In the case where an extent of flexion of the leg link 3 is not more than a predetermined extent, the coil spring 14 applies, to a third joint 8, a first biasing force for preventing the extent of flexion of the leg link 3 from decreasing due to gravity acting on a body weight support device A. In the case where the extent of flexion of the leg link 3 exceeds the predetermined extent, the coil spring 14 applies, to the third joint 8, a second biasing force for decreasing the extent of flexion, where the second biasing force is larger than the first biasing force and increases with an increase of the extent of flexion. This enables a sufficient support force to be generated when standing up from a half-sitting posture or a crouching posture, without significantly interfering with walking.

3 Claims, 5 Drawing Sheets

(56) References Cited

U.S. PATENT DOCUMENTS

| | | | | |
|---|---|---|---|---|
| 8,292,836 | B2 * | 10/2012 | Matsuoka et al. | 601/5 |
| 2006/0270951 | A1 * | 11/2006 | Ikeuchi | 601/5 |

FOREIGN PATENT DOCUMENTS

| | | |
|---|---|---|
| JP | 07-163607 | 6/1995 |
| JP | 2003-181789 | 7/2003 |
| JP | 2005-169052 | 6/2005 |
| JP | 2007-159971 | 6/2007 |
| JP | 2008-017981 | 1/2008 |
| JP | 2008-048753 | 3/2008 |
| JP | 2008-253539 | 10/2008 |
| WO | 2007/128299 | 11/2007 |

* cited by examiner

BODY WEIGHT SUPPORT DEVICE

TECHNICAL FIELD

The present invention relates to a body weight support device which supports part of a body weight of a user (person).

BACKGROUND ART

Conventionally, as this type of body weight support device, for example, Japanese Patent Application Laid-Open No. 2005-169052 discloses a body weight support aid composed of: a saddle on which the user sits in a standing posture; a stick bottom plate for supporting a foot sole; an upper stick integrated with the saddle and fixed to a thigh; a lower stick integrated with the stick bottom plate and fixed to a crus; and a knee flexion coil spring provided between the upper stick and the lower stick. In a swing phase during walking, the body weight support aid supports part of the body weight of the user with his/her knee flexed, by a biasing force of the knee flexion coil spring. The body weight support aid thus aids walking of a walking impaired person having a lower limb disease or the like. This allows the walking impaired person to rotate his/her knee joint and attain a stable gait.

SUMMARY OF THE INVENTION

Problem to be Solved by the Invention

However, in the body weight support aid disclosed in Japanese Patent Application Laid-Open No. 2005-169052, the biasing force of the knee flexion coil spring increases substantially proportionally with an increase of a flexion angle (knee angle) between the upper stick and the lower stick. This causes a problem that, when the user stands up from a half-sitting posture or a crouching posture, a sufficient support force for supporting part of the body weight cannot be generated depending on the biasing force of the knee flexion coil spring. In the case where the biasing force of the knee flexion coil spring is increased so that a sufficient support force is generated when the user stands up from a half-sitting posture or a crouching posture, it becomes necessary to lift the lower limb with a large force against the biasing force of the knee flexion coil spring in the swing phase during walking, as a result of which walking is significantly interfered with.

In view of the above-mentioned point, the present invention has an object of providing a body weight support device that can generate a sufficient support force when the user stands up from a half-sitting posture or a crouching posture, without significantly interfering with walking.

Means for Solving the Problems

To achieve the stated object, the present invention is a body weight support device including: a body weight support which supports part of a body weight of a user; a foot attachment attached to a foot of the user; and a leg link which connects the foot attachment to the body weight support, the leg link including: an upper link member connected to the body weight support; and a lower link member connected to the foot attachment, the upper link member and the lower link member being connected by a joint so as to enable flexion and extension, the body weight support device being characterized in that a biasing member is provided in the leg link, wherein in the case where an extent of flexion of the leg link is not more than a predetermined extent, the biasing member applies, to the joint, a first biasing force for preventing the extent of flexion of the leg link from decreasing due to gravity acting on the body weight support device, and in the case where the extent of flexion of the leg link exceeds the predetermined extent, the biasing member applies, to the joint, a second biasing force for decreasing the extent of flexion, the second biasing force being larger than the first biasing force and increasing with an increase of the extent of flexion.

According to the present invention, the biasing member is provided in the leg link. In the case where the extent of flexion of the leg link is not more than the predetermined extent, the biasing member applies, to the joint, the first biasing force for preventing the extent of flexion of the leg link from decreasing due to gravity acting on the body weight support device. This allows the user to flex his/her knee without feeling the burden of the weight of the body weight support device, so that walking is not significantly interfered with. In the case where the extent of flexion of the leg link exceeds the predetermined extent, the biasing member applies, to the joint, the second biasing force for decreasing the extent of flexion, where the second biasing force is larger than the first biasing force and increases with the increase of the extent of flexion. Therefore, when the user extends his/her knee which is flexed to such a degree that the extent of flexion of the leg link exceeds the predetermined extent, the user receives the second biasing force that increases with the increase of the extent of flexion, as a support force for supporting part of the body weight of the user. This allows the user to easily extend his/her knee. Thus, the biasing force applied to the joint by the biasing member differs depending on whether or not the extent of flexion of the leg link is not more than the predetermined extent. Hence, unlike in the case where the biasing force for decreasing the knee angle increases substantially proportionally with the increase of the knee angle as in the body weight support aid disclosed in above-mentioned Japanese Patent Application Laid-Open No. 2005-169052, it is possible to provide a body weight support device that can generate a sufficient support force when the user stands up from a half-sitting posture or a crouching posture, without significantly interfering with walking.

Moreover, in the present invention, it is desirable that the biasing member is a coil spring having characteristics that a change rate of elasticity with respect to a change of a compression amount is different between a first compression range in which the compression amount is not more than a predetermined amount and a second compression range in which the compression amount exceeds the predetermined amount, the change rate in the second compression range being larger than the change rate in the first compression range, and the coil spring is compressed as the extent of flexion of the leg link increases.

According to this, the biasing member and the body weight support device can be simplified in structure and reduced in size and cost. An example of the coil spring is a variable rate coil spring such as a double rate coil spring. Other types of springs such as a flat spring and a disc spring and other biasing members such as series-connected air springs are also applicable.

Moreover, in the present invention, it is desirable that the coil spring is provided in the upper link member, one end of the coil spring on a side of the joint is fixed, an other end of the coil spring on a side of the body weight support is connected with one end of a wire, and an other end of the wire is connected to the lower link member.

According to this, a structure of increasing the compression amount of the coil spring with the increase of the extent of flexion of the leg link can be easily achieved, so that the body weight support device can be simplified in structure and reduced in size and cost.

Moreover, in the present invention, it is desirable that the coil spring is provided in the upper link member, one end of the coil spring on a side of the joint is fixed, an other end of the coil spring on a side of the body weight support is connected with one end of a wire, and an other end of the wire is connected to a crank arm which is fixed to the lower link member concentrically with a joint axis of the joint.

According to this, too, a structure of increasing the compression amount of the coil spring with the increase of the extent of flexion of the leg link can be easily achieved, so that the body weight support device can be simplified in structure and reduced in size and cost.

MODE FOR CARRYING OUT THE INVENTION

A body weight support device A according to a first embodiment of the present invention is described below, with reference to drawings.

Figure 1:
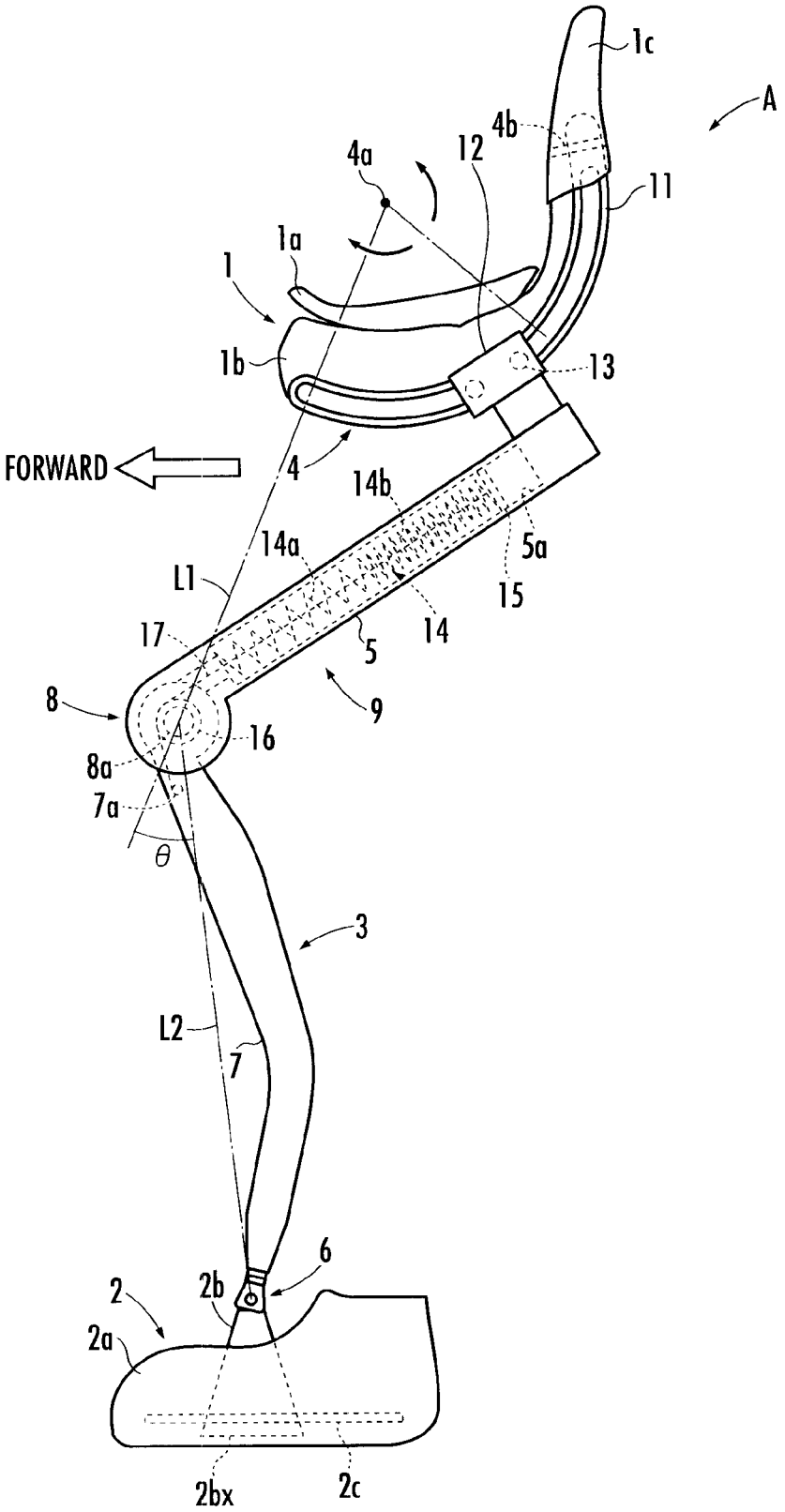
FIG. 1 is a side view showing a schematic structure of a body weight support device according to a first embodiment of the present invention.

As shown in FIG. 1, the body weight support device A includes: a seat 1 as a body weight support which supports part of a body weight of a user (not shown); a pair of left and right foot attachments 2 attached to the respective feet of the user; and a pair of left and right leg links 3 which connect the respective foot attachments 2 to the seat 1. The left and right foot attachments 2 have the same structure in bilateral symmetry with each other. The left and right leg links 3 have the same structure in bilateral symmetry with each other, too. Note that, in the description of this embodiment, a left-right direction of the body weight support device A means a left-right direction of the user having the foot attachments 2 attached to his/her feet (a direction substantially perpendicular to the plane of paper in FIG. 1).

Each leg link 3 includes: an upper link member 5 extending downward from the seat 1 via a first joint 4; a lower link member 7 extending upward from the foot attachment 2 via a second joint 6; and a third joint (joint) 8 connecting the upper link member 5 and the lower link member 7 midway between the first joint 4 and the second joint 6 so as to enable flexion and extension.

Moreover, the body weight support device A includes a passive drive mechanism 9 for driving the third joint 8, for each leg link 3. The passive drive mechanism 9 of the left leg link 3 and the passive drive mechanism 9 of the right leg link 3 have the same structure in bilateral symmetry with each other.

The seat 1 includes: a saddle-shaped seat portion 1*a* which the user sits astride (so that the seat portion 1*a* is located between the roots of both legs of the user); a base frame 1*b* attached to a lower surface of the seat portion 1*a*; and a backrest 1*c* attached to a back end (an upward raised portion at the back of the seat portion 1*a*) of the base frame 1*b*.

The first joint 4 of each leg link 3 is a joint having rotational degrees of freedom about two joint axes in a forward-backward direction and the left-right direction (two degrees of freedom). In more detail, each first joint 4 includes an arc-shaped guide rail 11 that is assembled to the base frame 1*b* of the seat 1. A slider 12 fixed to an upper end of the upper link member 5 of each leg link 3 is movably engaged with the guide rail 11, via a plurality of rollers 13 axially attached to the slider 12. This enables each leg link 3 to perform forward-backward swing (forward-backward swing movement) about a first joint axis of the first joint 4, where the first joint axis of the first joint 4 is a left-right direction axis passing through a center of curvature 4*a* of the guide rail 11 (in more detail, an axis perpendicular to a plane that includes the arc of the guide rail 11).

Moreover, the guide rail 11 is pivotally supported at the back upper end of the support frame 1*b* of the seat 1 via a shaft 4*b* having a shaft center in the forward-backward direction, so as to swing about the shaft center of the shaft 4*b*. This enables each leg link 3 to perform left-right direction swing (adduction and abduction) about a second joint axis of the first joint 4, where the second joint axis of the first joint 4 is the shaft center of the shaft 4*b*. Note that, in this embodiment, the second joint axis of the first joint 4 is a joint axis common to the right side first joint 4 and the left side first joint 4.

As described above, the first joint 4 is configured so that each leg link 3 can perform swing motion about the two joint axes in the forward-backward direction and the left-right direction.

Note that the number of rotational degrees of freedom of the first joint is not limited to two. As an example, the first joint may be configured to have rotational degrees of freedom about three joint axes (three degrees of freedom). As another example, the first joint may be configured to have only a rotational degree of freedom about one joint axis in the left-right direction (one degree of freedom).

Each foot attachment 2 includes a shoe 2*a* which the user wears on his/her corresponding foot and a connecting member 2*b* projecting upward from inside the shoe 2*a*, and is in contact with the ground via the shoe 2*a* in a state where the user's each leg is a standing leg (supporting leg). The connecting member 2*b* of each foot attachment 2 is connected with a lower end of the lower link member 7 of the corresponding leg link 3, via the second joint 6. In this case, the connecting member 2*b* integrally has a flat portion 2*bx* positioned under an insole 2*c* in the shoe 2*a* (i.e., between the bottom of the shoe 2*a* and the insole 2*c*). The connecting member 2*b* including the flat portion 2*bx* is formed by a relatively high-rigid member so that, when the foot attachment 2 is in contact with the ground, part of a floor reaction force acting on the foot attachment 2 from the floor (i.e., a support force sufficient for supporting at least a combined weight of the body weight support device A and part of the body weight of the user) can act on the leg link 3 via the connecting member 2*b* and the second joint 6. Note that the foot attachment 2 may include a form of a slipper or the like, instead of the shoe 2*a*.

In this embodiment, the second joint 6 is formed by a free joint such as a ball joint, and is a joint having rotational degrees of freedom about three axes. However, the second joint may instead be a joint having, for example, rotational degrees of freedom about two axes in the forward-backward direction and the left-right direction or about two axes in an upward-downward direction and the left-right direction.

The third joint 8 is a joint having a rotational degree of freedom about one axis in the left-right direction, and has a shaft 8*a* that pivotally supports an upper end of the lower link member 7 at a lower end of the upper link member 5. A shaft center of the shaft 8*a* is substantially parallel to the first joint axis of the first joint 4 (the axis perpendicular to the plane that includes the arc of the guide rail 11). The shaft center of the shaft 8*a* serves as a joint axis of the third joint 8, and the lower link member 7 is rotatable relative to the upper link member 5 about this joint axis. This enables flexion and extension of the leg link 3 at the third joint 8.

Each passive drive mechanism 9 applies, to the third joint 8 of the leg link 3 corresponding to the foot attachment 2 which is in contact with the ground, a rotational drive force (torque) in an extension direction of the leg link 3 so that a load (upward support force) for supporting part of the body weight of the user sitting on the seat 1 acts on the user from the seat 1. Each passive drive mechanism 9 includes: a coil spring 14 as a biasing member disposed inside a hollow 5*a* formed in the upper link member 5 of the leg link 3; a sliding plate 15 to which one end of the coil spring 14 is fixed and which slides in the hollow 5*a*; a pulley 16 rotatably supported by the shaft 8*a* of the third joint 8; and a wire 17 having one end fixed to the sliding plate 15 and the other end fixed to the lower link member 7.

Figure 2:
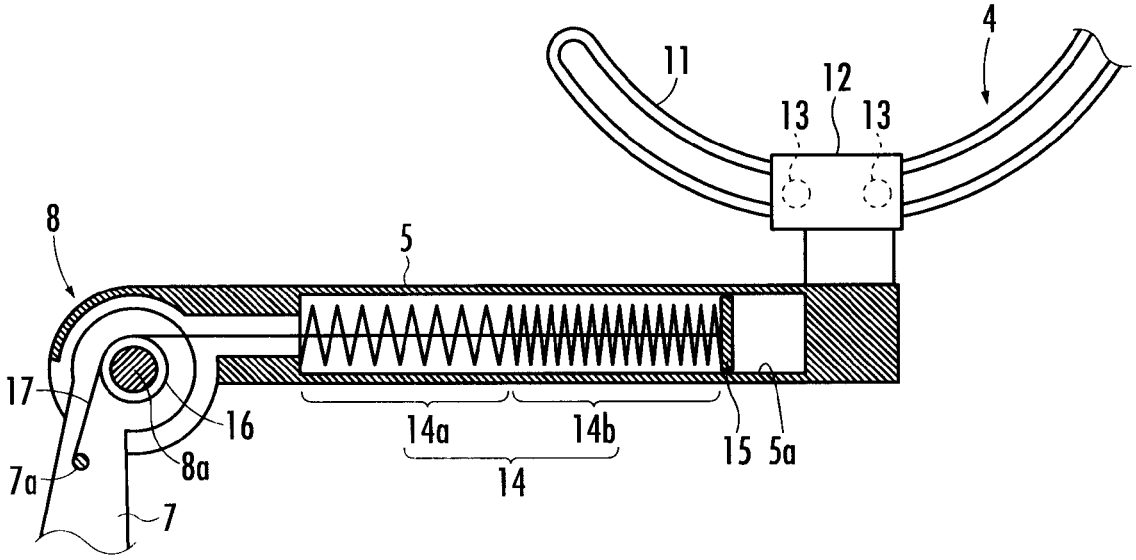
FIG. 2 is a cutaway side view of an upper link member of the body weight support device in FIG. 1.
Figure 3:
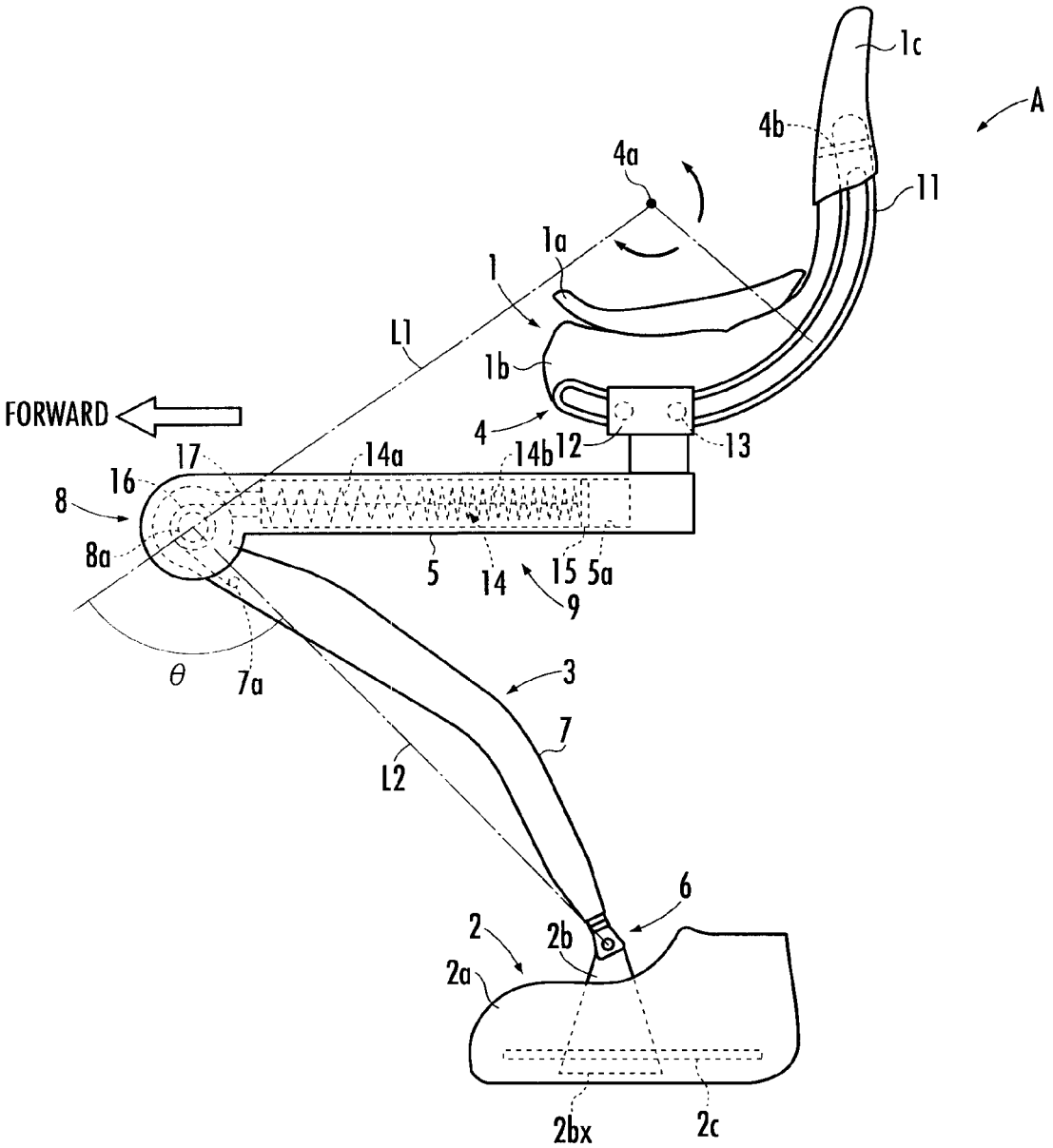
FIG. 3 is a side view showing a schematic structure of the body weight support device when a leg link is flexed.

As shown in FIGS. 1 and 2, the cylindrical hollow 5*a* having a shaft center in its longitudinal direction is formed in the upper link member 5. The coil spring 14 whose end on the seat 1 side is fixed to the sliding plate 15 is disposed inside the hollow 5*a*. The end of the coil spring 14 on the third joint 8 side is fixed to or fixedly contacts an end surface of the hollow 5*a*. The sliding plate 15 is disc-shaped so as to be slidable in the hollow 5*a*, and one end of the wire 17 is connected to a center of the sliding plate 15. The pulley 16 is rotatably supported by the shaft 8*a* of the third joint 8, and the wire 17 runs over the pulley 16. The other end of the wire 17 is fixed to a pin 7*a* provided near the end of the lower link member 7 on the first joint 4 side. Note that a hollow is formed in areas of the upper link member 5 and the lower link member 7 where the wire 17 is present. Here, a plurality of pins 7*a* may be provided so that a pin 7*a* to which the wire 17 is connected is selected according to the size, preference, and the like of the user.

According to such a structure, a biasing force F generated by the coil spring 14 applies, to the third joint 8, a rotational drive force in a direction in which a knee angle θ decreases, that is, in the extension direction of the leg link 3. Note that the knee angle θ is an angle formed by a straight line L1 connecting the shaft 8*a* of the third joint 8 and the center of curvature 4*a* of the guide rail 11 and a straight line L2 connecting the shaft 8*a* of the third joint 8 and the second joint 6, when the leg link 3 is viewed from the direction of the shaft center of the shaft 8*a* of the third joint 8. The knee angle θ increases with an increase of an extent of flexion of the leg link 3

Note that the knee angle θ is variable in a predetermined range from a minimum angle θ0 to a maximum angle θ1, for example, substantially from 30 degrees to 120 degrees. In this embodiment, the knee angle θ is variable in a range from 27 degrees to 117 degrees. Link lengths of the upper link member 5 and the lower link member 7 and the like are set so that the knee angle θ is the minimum angle θ0 when the user of the body weight support device A is in an upright posture (a standing posture with both legs extending straight). A variable range of the extent of flexion of each leg link 3 is set by a mechanical limitation imposed by a stopper member (not shown) included in the third joint 8, as a result of which the knee angle θ is variable in the predetermined range.

The coil spring 14 is a double rate coil spring formed by series-connecting two springs of different spring constants (spring rates). In detail, the coil spring 14 is formed by series-connecting a portion 14*a* made of a coil spring of a small spring constant and a portion 14*b* made of a coil spring of a large spring constant. The portions 14*a* and 14*b* significantly differ in spring constant. A ratio in spring constant of the portion 14*b* to the portion 14*a* is preferably 10 times to 30 times. For example, the ratio is 20 times. A compression amount is proportional to an inverse of a spring constant. Accordingly, when such a coil spring 14 is compressed, compression of the portion 14*a* initially accounts for most of the compression amount. When the coil spring 14 is compressed more, wire-to-wire contact occurs in the portion 14*a*, and the portion 14*a* can no longer be compressed. Subsequently, only the portion 14*b* is compressed. Therefore, the coil spring 14 has a small spring constant (substantially the same spring constant as the portion 14*a*) while the length of the coil spring 14 is in a range from a free length to the occurrence of the wire-to-wire contact of the portion 14*a*, and subsequently has a large spring constant (the same spring constant as the portion 14*b*). That is, a total spring constant of the coil spring 14 varies in such a manner that the total spring constant is a substantially small spring constant in a first compression range in which the compression amount (elastic deformation amount) of the coil spring 14 is not more than a predetermined amount, and changes to a substantially large spring constant in a second compression range in which the compression amount (elastic deformation amount) exceeds the predetermined amount. Thus, an apparent spring constant of the coil spring 14 varies in two levels, according to the compression amount of the coil spring 14. Note that such a coil spring 14 can be obtained by forming the portions 14*a* and 14*b* with different materials, wire diameters, wire-to-wire pitches, or the like.

A length of the wire 17, a position of the fixation pin 7*a*, and the like are set so that the coil spring 14 is compressed from the natural length to a predetermined compression amount in the first compression range when the knee angle θ is the minimum angle θ0. This being so, when the knee angle θ is the minimum angle θ0, the coil spring 14 generates a predetermined biasing force (initial biasing force) F0, as a result of which a rotational drive force (preload) for extending the leg link 3 is applied to the third joint 8.

Figure 4:
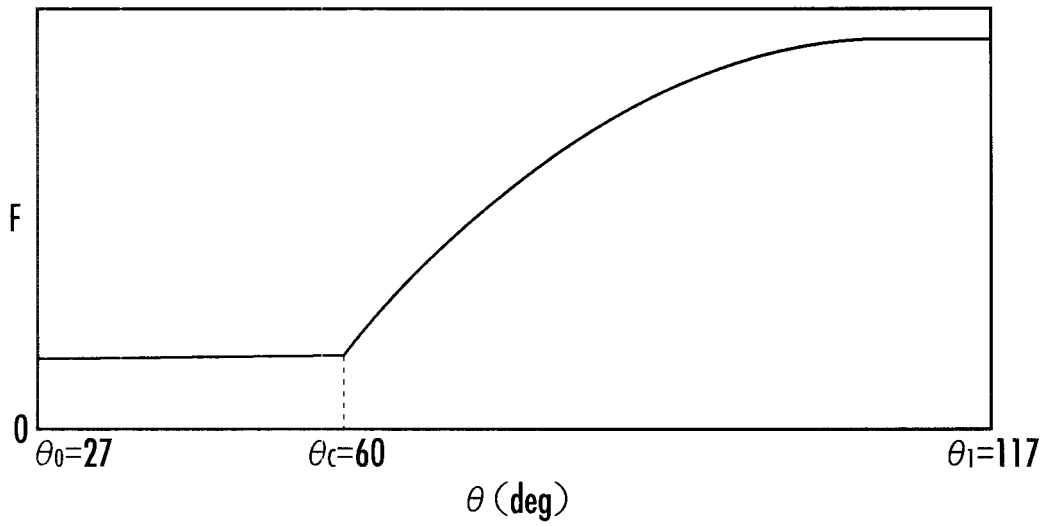
FIG. 4 is a graph showing a relation between a knee angle and a biasing force.

The following describes the biasing force F of the coil spring 14 of each leg link 3 with respect to the knee angle θ, based on a graph shown in FIG. 4.

As the knee angle θ increases, the flexion angle of the leg link 3 increases, and the coil spring 14 is compressed. However, in the case where the knee angle θ is in a range from the minimum angle θ0 to a predetermined angle θc, the compression amount of the coil spring 14 is within the first compression range, and so the biasing force (first biasing force) F increases very gradually from the initial biasing force F0. That is, in the case where θ0≤θ≤θc, the biasing force F does not significantly change from the initial biasing force F0 but is substantially constant, with respect to the change of θ. Note that the natural lengths of the portions 14*a* and 14*b* of the coil spring 14 and the like are set so that the predetermined angle θc is, for example, substantially the same as a maximum knee angle realized when the user walks on the flat ground. In this embodiment, the natural lengths of the portions 14*a* and 14*b* of the coil spring 14 and the like are set so that the predetermined angle θc is 60 degrees. Moreover, the spring constants and the like of the portions 14*a* and 14*b* of the coil spring 14 are set so that the initial biasing force F0 prevents the knee angle θ from increasing (i.e., prevents the extent of flexion of the leg link 3 from increasing) due to gravity (hereafter referred to as a self weight) acting on the body weight support device A.

Thus, in the case where the knee angle θ is within a range (swing phase) realized when the user walks on the flat ground, the coil spring 14 generates such a biasing force F that applies, to the third joint 8, a rotational drive force for preventing the knee angle θ from increasing due to the self weight. In this way, the body weight support device A supports the self weight. This keeps the body weight support device A from falling, and allows the user to walk on the flat ground without feeling the burden of the weight of the body weight support device A.

In the case where the knee angle θ exceeds the predetermined angle θc, the compression amount of the coil spring 14 is within the second compression range, and so the biasing force (second biasing force) F increases substantially linearly with the increase of the knee angle θ, at a larger increase rate than in the case where θ≤θc. That is, in the case where θc<θ≤θ1, the biasing force F increases substantially linearly from the initial biasing force F0, with respect to the change of the knee angle θ. The spring constant of the portion 14*b* of the coil spring 14 and the like are set so that, when the knee angle θ is close to the maximum angle θ1, e.g., when the knee angle θ is about 100 degrees, the biasing force F generated by the coil spring 14 applies a rotational drive force for decreasing the knee angle θ (decreasing the extent of flexion of the leg link 3) to the third joint 8 to thereby support part of the body weight of the user, such as about 1/10 to 1/3 of the body weight of the user.

Thus, in the case where the knee angle θ exceeds such a knee angle range that is realized when the user walks on the flat ground, the coil spring 14 generates such a biasing force F that applies, to the third joint 8, a larger rotational drive force than a force for supporting the self weight so as to decrease the knee angle θ, thereby supporting part of the body weight of the user. Therefore, when extending the significantly flexed leg link 3 as in the case where the user walks up a slope, stairs, and the like or the user stands up from a half-sitting posture or a crouching posture, the body weight support device A generates a sufficient support force, thereby allowing the user to extend his/her knee with a smaller burden. In this way, for example when the user stands up while carrying a heavy load by supporting on both feet, a burden on his/her knee, waist, and the like can be reduced, and an injury and the like can be prevented.

Though the biasing force F does not increase linearly with the change of the knee angle θ in a range where the knee angle θ is close to the maximum angle θ1, this is attributed to characteristics of the coil spring 14. As an alternative, a coil spring of such characteristics that linearly increase the biasing force F with the change of the knee angle θ until the knee angle θ reaches the maximum angle θ1 may be used.

As described above, the biasing force F of the coil spring 14 significantly differs depending on whether or not the knee angle θ is not more than the predetermined angle θc, and a rotational drive force appropriate in each instance is applied to the third joint 8. Hence, unlike in the case where the biasing force for decreasing the knee angle increases substantially proportionally with the increase of the knee angle as in the body weight support aid disclosed in above-mentioned Japanese Patent Application Laid-Open No. 2005-169052, it is possible to generate a sufficient support force when the user stands up from a half-sitting posture or a crouching posture, without significantly interfering with walking.

Moreover, the passive drive mechanism 9 passively applies the rotational drive force to the third joint 8 according to the knee angle θ, by using the coil spring 14. This contributes to safety with no runaway risk or the like, unlike in the case of actively applying the rotational drive force by using an actuator, a motor, and the like. Besides, there is no need of a controller for controlling an actuator, a motor, and the like.

Figure 5:
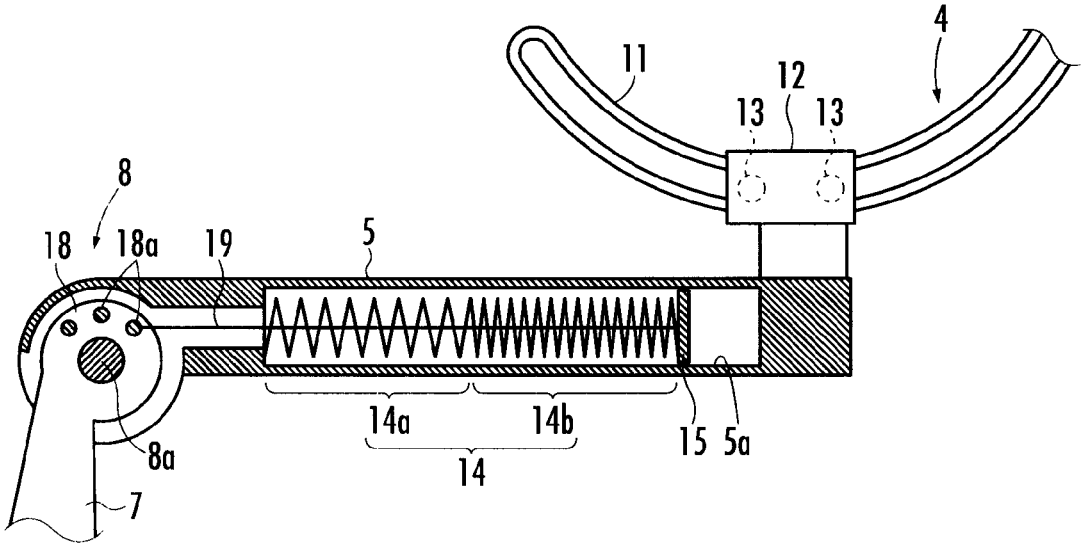
FIG. 5 is a cutaway side view of an upper link member of a body weight support device according to a second embodiment of the present invention.

A body weight support device according to a second embodiment of the present invention is described below, with reference to FIG. 5. Since this body weight support device is similar to the body weight support device A described above, only the differences from the body weight support device A are described below.

Each passive drive mechanism of the body weight support device includes: the coil spring 14 disposed inside the hollow 5*a* formed in the upper link member 5 of the leg link 3; the sliding plate 15 to which one end of the coil spring 14 is fixed and which slides in the hollow 5*a*; a crank arm 18 fixed to the lower link member 7 concentrically with the joint axis of the third joint 8; and a wire 19 having one end fixed to the sliding plate 15 and the other end fixed to a pin 18*a* provided at an end of the crank arm 18.

The crank arm 18 is integral with the lower link member 7 concentrically with the joint axis of the third joint 8, and a plurality of pins 18*a* are provided at its end eccentric from the joint axis. The end of the wire 19 is connected to one of the plurality of pins 18*a*. Note that the pin 18*a* to which the wire 19 is connected can be selected according to the size, preference, and the like of the user.

According to such a structure, the biasing force F generated by the coil spring 14 applies, to the third joint 8, a rotational drive force in the direction in which the knee angle θ decreases, i.e., in the extension direction of the leg link 3, as in the first embodiment. The biasing force F of the coil spring 14 of each leg link 3 with respect to the knee angle θ is substantially the same as that shown in the graph of FIG. 4.

The above embodiments describe the case where the coil spring 14 is provided in the upper link member 5, but the coil spring 14 may instead be provided in the lower link member 7. Alternatively, the coil spring 14 may be provided between the upper link member 5 and the lower link member 7 in such a manner that, for example, one end of the coil spring 14 is located near the first joint 4 of the upper link member 5 and the other end of the coil spring 14 is located near the second joint 6 of the lower link member 7. In these cases, too, the coil spring 14 is configured to increase in compression force with the increase of the knee angle θ.

The above embodiments describe the case where the coil spring 14 is a double rate coil spring formed by series-connecting two springs of different spring constants, but the coil spring 14 may be formed by series-connecting three or more springs of different spring constants so as to have three or more compression ranges. Alternatively, the coil spring 14 may be a variable rate coil spring whose spring constant varies continuously.

The above embodiments describe the case where the body weight support is the seat 1 having the saddle-shaped seat portion 1*a*, but the body weight support may be a harness-shaped flexible member worn around the waist of the user. Such a body weight support preferably includes a portion that contacts the user between the roots of both legs of the user in order to apply an upward support force to the user's trunk.

The above embodiments describe the case where the first joint 4 has the arc-shaped guide rail 11 and the center of curvature of the guide rail 11 about which the corresponding leg link 3 swings forward and backward, i.e., the forward-backward swing center 4*a* of the leg link 3, is located above the seat 1. However, the first joint 4 may be made to swing at least in the forward-backward direction, for example by a simple joint structure in which the upper end of the leg link 3 is pivotally supported by a lateral direction (left-right direction) shaft on a side of the seat 1 or under the seat 1.

Moreover, to aid walking of the user whose one leg or one upper limb is impaired due to fracture or the like, only one of the left and right leg links 3 or one of the left and right upper limb links corresponding to the impaired leg or upper limb of the user may be included while omitting the other leg link or upper limb link.

The invention claimed is:

1. A body weight support device including: a body weight support which supports part of a body weight of a user; a foot attachment configured to be attached to a foot of the user; and a leg link which connects the foot attachment to the body weight support, the leg link including: an upper link member connected to the body weight support; and a lower link member connected to the foot attachment, the upper link member and the lower link member being connected by a joint so as to enable flexion and extension, the body weight support device comprising:

a biasing member is provided in the leg link, wherein in a case where an extent of flexion of the leg link is not more than a predetermined extent, the biasing member applies, to the joint, a first biasing force for preventing the extent of flexion of the leg link from increasing due to gravity acting on the body weight support device, and in a case where the extent of flexion of the leg link exceeds the predetermined extent, the biasing member applies, to the joint, a second biasing force for decreasing the extent of flexion, the second biasing force being larger than the first biasing force and increasing with an increase of the extent of flexion, wherein the biasing member is a coil spring, the coil spring is formed by series-connecting portions of different spring constants or has a portion whose spring constant varies continuously, and the coil spring is provided so as to be compressed as the extent of flexion of the leg link increases.

2. The body weight support device according to claim 1, wherein the coil spring is provided in the upper link member, one end of the coil spring on a side of the joint is fixed, an other end of the coil spring on a side of the body weight support is connected with one end of a wire, and an other end of the wire is connected to the lower link member.

3. The body weight support device according to claim 1, wherein the coil spring is provided in the upper link member, one end of the coil spring on a side of the joint is fixed, an other end of the coil spring on a side of the body weight support is connected with one end of a wire, and an other end of the wire is connected to a crank arm which is fixed to the lower link member concentrically with a joint axis of the joint.

* * * * *